US007047775B2

(12) United States Patent
Huang

(10) Patent No.: US 7,047,775 B2
(45) Date of Patent: May 23, 2006

(54) ASSEMBLING STRUCTURE FOR A DOOR LOCK

(75) Inventor: Chao-Ming Huang, Kaohsiung Hsien (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 101 days.

(21) Appl. No.: 10/759,055

(22) Filed: Jan. 20, 2004

(65) Prior Publication Data

US 2005/0155398 A1 Jul. 21, 2005

(51) Int. Cl.
*E05B 13/10* (2006.01)

(52) U.S. Cl. ..... 70/224; 70/369; 70/371

(58) Field of Classification Search ..... 70/221–224, 70/367–371

See application file for complete search history.

(56) References Cited

U.S. PATENT DOCUMENTS

| | | | | | |
|---|---|---|---|---|---|
| 3,286,773 | A * | 11/1966 | Russell et al. | 70/371 |
| 4,435,967 | A * | 3/1984 | Best et al. | 70/224 |
| 4,995,249 | A * | 2/1991 | Preissler et al. | 70/224 |
| 5,398,531 | A * | 3/1995 | Shen | 70/224 |
| 5,507,163 | A * | 4/1996 | Juang | 70/369 |
| 5,605,064 | A * | 2/1997 | Katayama et al. | 70/224 |
| 5,688,005 | A * | 11/1997 | Ellis | 292/348 |
| 5,752,399 | A * | 5/1998 | Shen | 70/224 |
| 5,927,777 | A * | 7/1999 | Kuo et al. | 292/358 |
| 6,012,311 | A * | 1/2000 | Duckwall | 70/369 |
| 6,014,877 | A * | 1/2000 | Shen | 70/371 |
| 6,109,080 | A * | 8/2000 | Chen et al. | 70/371 |
| 6,360,570 | B1 * | 3/2002 | Shen | 70/224 |
| 6,874,341 | B1 * | 4/2005 | Shen | 70/224 |
| 6,886,379 | B1 * | 5/2005 | Simon et al. | 70/215 |
| 2001/0023600 | A1 * | 9/2001 | Pompeii | 70/224 |
| 2002/0104345 | A1 * | 8/2002 | Wang | 70/472 |
| 2002/0189305 | A1 * | 12/2002 | Shen | 70/224 |
| 2004/0031300 | A1 * | 2/2004 | Wu | 70/223 |

* cited by examiner

*Primary Examiner*—Suzanne Dino Barrett
(74) *Attorney, Agent, or Firm*—Bacon & Thomas PLLC

(57) ABSTRACT

An assembling structure for the door lock includes a lever, a lock core unit, an axial tube and an adapter. The lever has a compartment and an engaging member formed therein. The axial tube provides a longitudinal slot and a transverse-retaining recession formed therein. The adapter also correspondingly provides a positioning member. Firstly, when the adapter and the axial tube are assembled, the positioning member of the adapter is engaged with the transverse retaining recession of the axial tube via the longitudinal slot so that the axial tube and the adapter constitute a combination unit. Secondly, assembling the lever and the combination unit, the engaging member of the lever is engaged with the longitudinal slot of the axial tube. Due to obstruction of the engaging member of the lever in the longitudinal slot, the positioning member of the adapter is confined and unable to return to the longitudinal slot.

8 Claims, 8 Drawing Sheets

ASSEMBLING STRUCTURE FOR A DOOR LOCK

BACKGROUND OF THE INVENTION

1. Field of the Invention

The present invention is related to an assembling structure for a door lock. More particularly, the present invention is related to the assembling structure of a lever for retaining an axial tube and an adapter therein.

2. Description of the Related Art

Referring initially to FIG. 1, a conventional assembling structure for a door lock includes a lever 11, a lock core unit 12, an axial tube 13 and an adapter 14. The lever 11 has a compartment 111 and an engaging member 112 formed therein. In assembling, the compartment 111 of the lever 11 is used to accommodate the lock core unit 12, the axial tube 13 and the adapter 14 nested therein. The engaging member 112 of the lever 11 is used to retain the axial tube 13 which is mechanically connected to the adapter 14. The axial tube 13 provides with a recession 131 and a longitudinal slot 132. The adapter 14 also correspondingly provides with a positioning member 141 engaging with the recession 131 of the axial tube 13, thereby combining the axial tube 13 with the adapter 14. When the axial tube 13 is inserted into the compartment 111 of the lever 11, the longitudinal slot 132 of the axial tube 13 is engaged with the engaging member 112 of the lever 11 that the rotational movement of the axial tube 13 is limited. Consequently, the lever 11 is able to synchronously rotate the axial tube 13. Furthermore, the lock core unit 12 is mounted to an end of the axial tube 13 via the adapter 14 so that the combination of the lock core unit 12, the axial tube 13 and the adapter 14 constitutes a mechanism unit.

However, in assembling operation, when the positioning member 141 of the adapter 14 is engaged with the recession 131 of the axial tube 13, the recession 131 can only prevent an axial movement of the adapter 14 with respect to the axial tube 13. On the contrary, the recession 131 cannot prevent a rotational movement of the adapter 14 with respect to the axial tube 13. The insertion of the lock core unit 12 into the compartment 111 of the lever 11 may be obstructed by the positioning member 141 of the adapter 14 once a rotational movement of the adapter 14 with respect to the axial tube 13 occurs. Consequently, it is certain that the assembling efficiency for the lever 11 and the lock core unit 12 is reduced. In trying to overcome the above problem, another conventional assembling structure for a door lock will be discussed below.

Turning now to FIG. 2, another conventional assembling structure for a door lock includes a lever 21, a lock core unit 22, an axial tube 23 and an adapter 24. Similarly, the lever 21 has a compartment 211 and an engaging member 212 formed therein. In assembling, the compartment 211 of the lever 21 is used to accommodate the lock core unit 22, the axial tube 23 and the adapter 24 nested therein. The engaging member 212 of the lever 21 is used to retain the axial tube 23 which is mechanically connected to the adapter 24. The axial tube 23 provides a recession 231 and a longitudinal slot 232. The adapter 24 also correspondingly provides a positioning member 241, a pair of flanges 242 and a notch 243. The positioning member 241 is engaged with the recession 231 of the axial tube 23, thereby combining the axial tube 23 with the adapter 24 and preventing an axial movement of the adapter 24 with respect to the axial tube 23. The notch 243 is formed between the two flanges 242 and used to engage with the engaging member 212 of the lever 21 to prevent a rotational movement of the adapter 24 with respect to the lever 21. When the axial tube 23 is inserted into the compartment 211 of the lever 21, the longitudinal slot 232 of the axial tube 23 is engaged with the engaging member 212 of the lever 21 such that the rotational movement of the axial tube 23 is limited. Consequently, the lever 21 is able to synchronously rotate the axial tube 23. Meanwhile, since the notch 243 of the adapter 24 is engaged with the engaging member 212 of the lever 21, the rotational movement of the adapter 24 with respect to the lever 21 and the axial tube 23 is limited. Furthermore, the lock core unit 22 is mounted to an end of the axial tube 23 via the adapter 22 so that the combination of the lock core unit 22, the axial tube 23 and the adapter 24 constitutes a mechanism unit.

Although engaging the notch 243 of the adapter 24 with the engaging member 212 of the lever 21 can prevent from the rotational movement of the adapter 24, it sophisticated the entire structure of the door lock. Further, the notch 243 of the adapter 24 must be manufactured by casting and is thus weakened. Hence, it results in an increase of manufacture cost.

The present invention intends to provide an assembling structure for a door lock, which employs an engaging member of a lever to retain an axial tube and an adapter in such a way to mitigate and overcome the above problem.

SUMMARY OF THE INVENTION

The primary objective of this invention is to provide an assembling structure for a door lock, which employs an engaging member of a lever to retain an axial tube and an adapter to prevent rotational movements of elements. Thereby, it can simplify the entire structure of the door lock.

The secondary objective of this invention is to provide the assembling structure for the door lock, which includes a lock core unit and an elastic member attached thereto to adjust an axial length suitable for various specifications of levers. Thereby, it can avoid manufacturing various specifications of the lock core units.

The assembling structure for the door lock in accordance with the present invention includes a lever, a lock core unit, an axial tube and an adapter. The lever has a compartment and an engaging member formed therein. The axial tube provides a longitudinal slot and a transverse retaining recession formed therein. The adapter also correspondingly provides a positioning member. Firstly, when the adapter and the axial tube are assembled, the positioning member of the adapter is engaged with the transverse-retaining recession of the axial tube via the longitudinal slot so that the axial tube and the adapter constitute a combination unit. Secondly, assembling the lever and the combination unit of the axial tube and the adapter, the engaging member of the lever is engaged with the longitudinal slot of the axial tube. Due to obstruction of the engaging member of the lever in the longitudinal slot of the axial tube, the positioning member of the adapter is confined and unable to return to the longitudinal slot of the axial tube. Consequently, no rotational movement of the adapter with respect to the axial tube is allowed.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
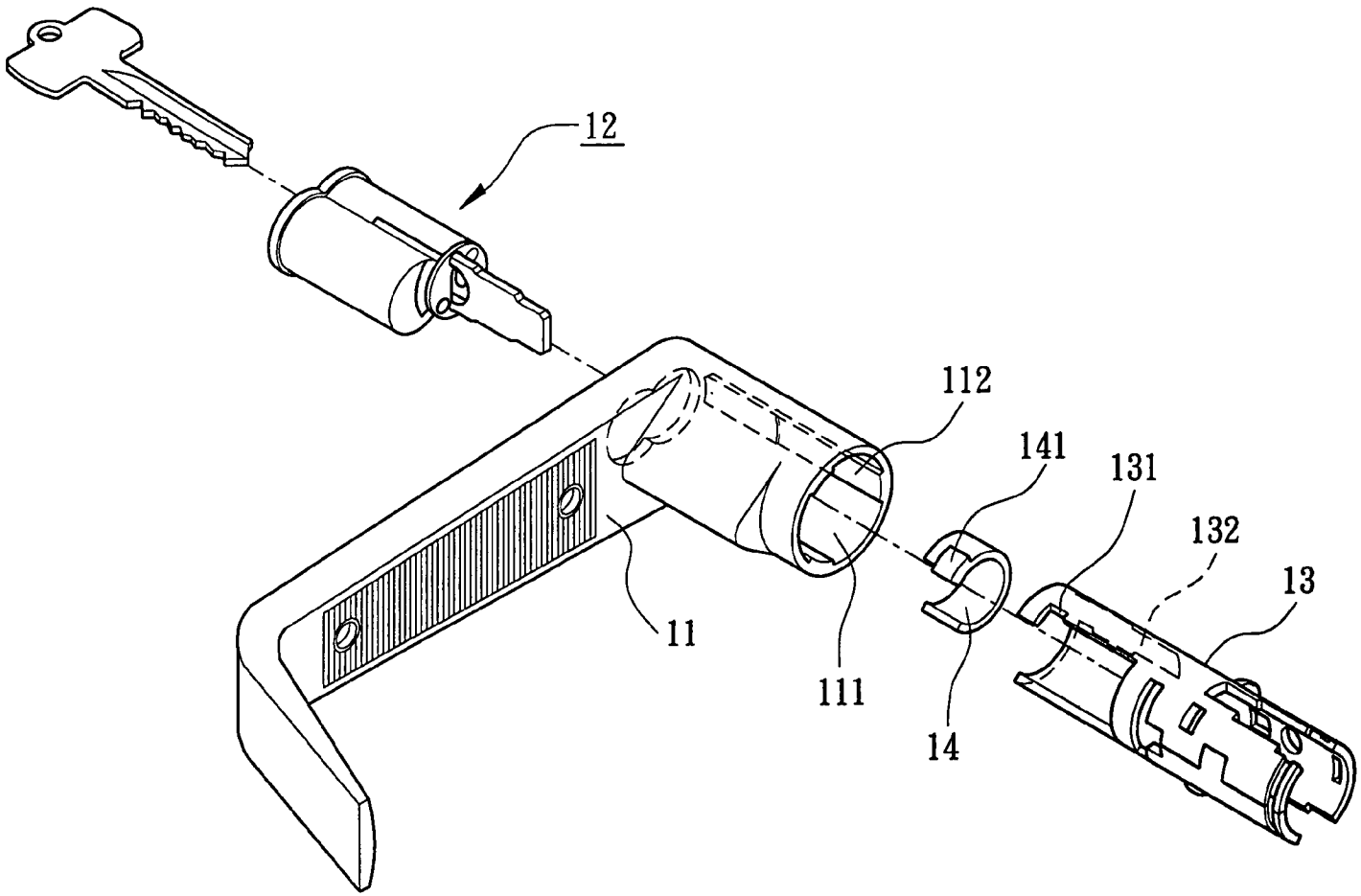
FIG. 1 PRIOR ART
FIG. 1 is an exploded perspective view of a conventional assembling structure for a door lock in accordance with the prior art.
Figure 2:
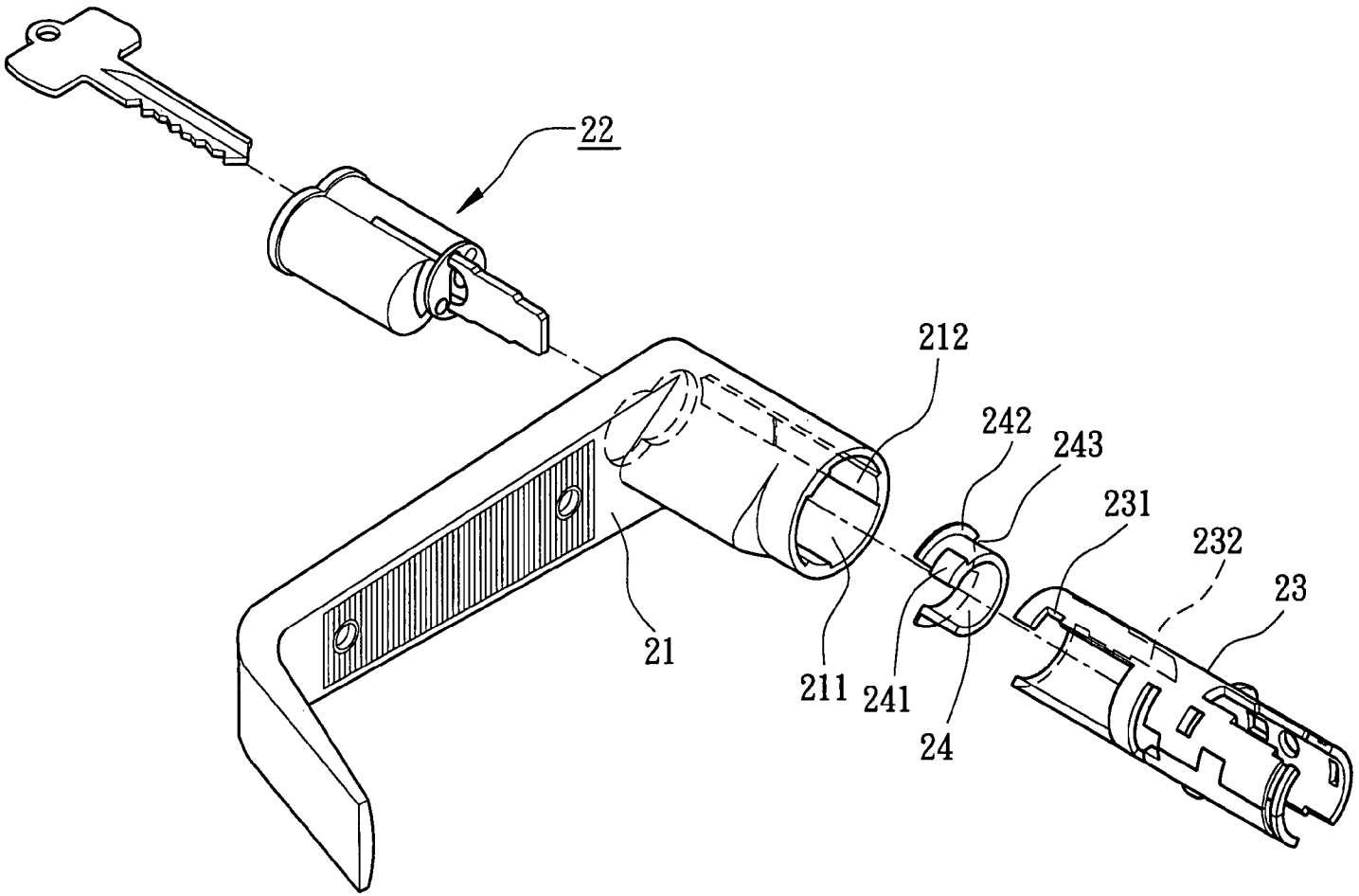
FIG. 2 PRIOR ART
FIG. 2 is an exploded perspective view of another conventional assembling structure for a door lock in accordance with the prior art.
Figure 3:
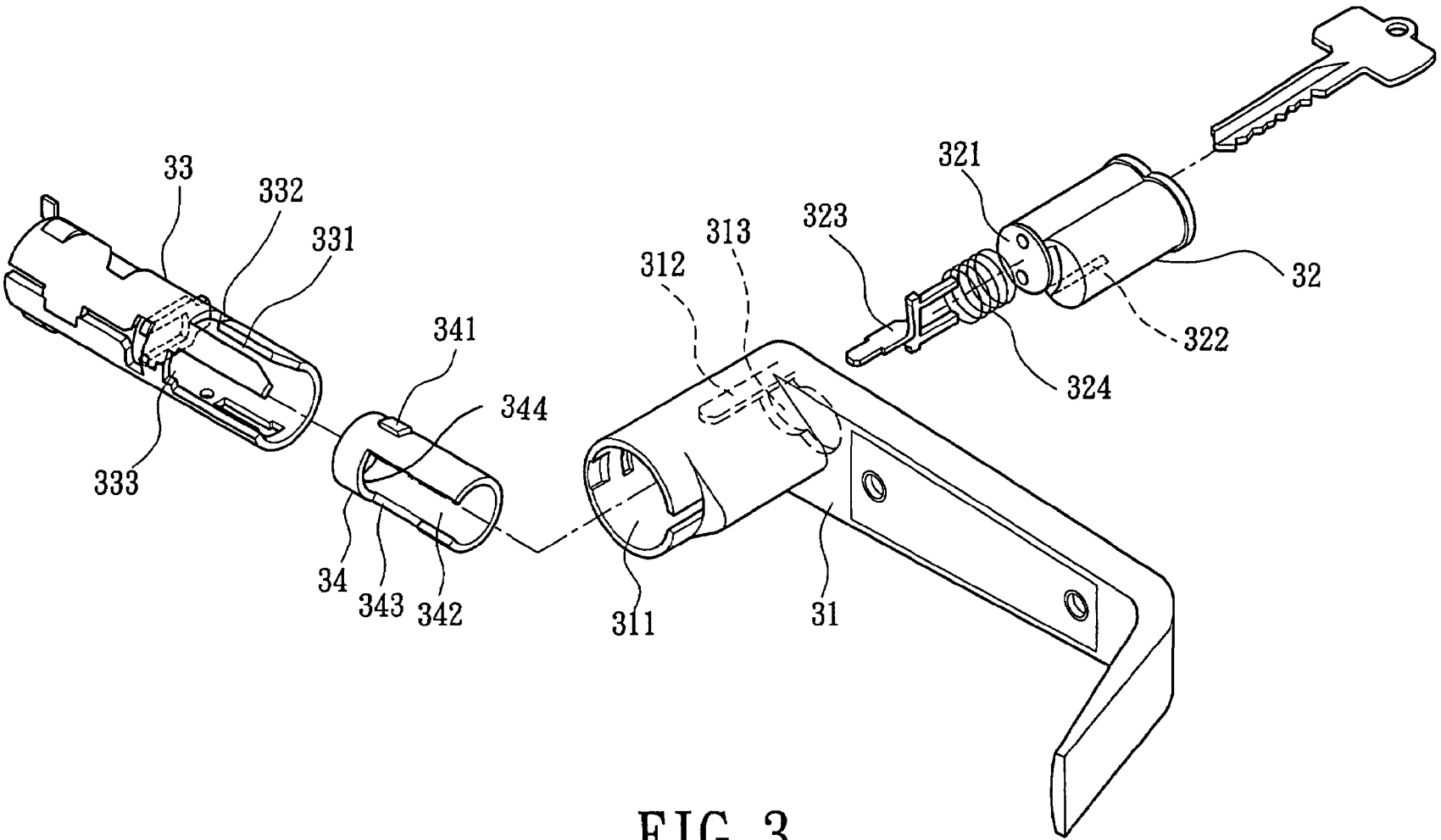
FIG. 3 is an exploded perspective view of an assembling structure for a door lock in accordance with a first embodiment of the present invention.
Figure 4:
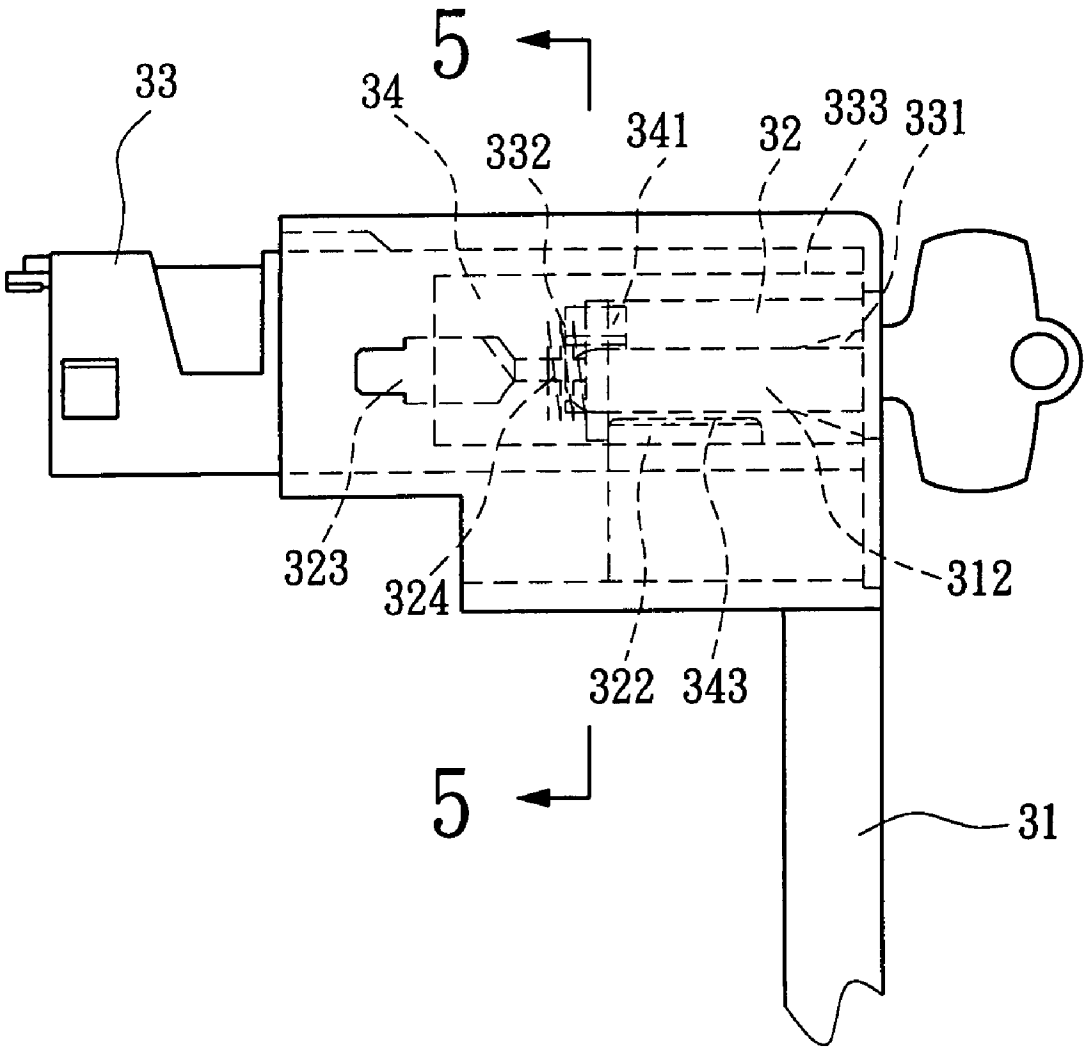
FIG. 4 is a schematic side view of the assembling structure for the door lock in accordance with the first embodiment of the present invention.

Referring to FIGS. 3 and 4, an assembling structure for a door lock in accordance with a first embodiment of the present invention essentially includes a lever 31, a lock core unit 32, an axial tube 33 and an adapter 34 assembled together. 4

Construction of the lever 31 shall be described in detail, referring again to FIGS. 3 and 4. The lever 31 is a door lever having relatively rigid and strong to withstand normal use and essentially consists of a compartment 311, an engaging member 312 and an assembling hole 313. In assembling, the compartment 311 of the lever 31 is used to accommodate the lock core unit 32, the axial tube 33 and the adapter 34 nested therein. The engaging member 312 of the lever 31 is longitudinally extended and located at an end proximate the assembling hole 313. The engaging member 312 is used to retain the axial tube 33 which is mechanically connected to the adapter 34. The assembling hole 313 is defined on an end of the compartment 311 and has a configuration somewhat like figure eight.

Further, construction of the lock core unit 32 shall be described in detail, referring again to FIGS. 3 and 4. The lock core unit 32 is connected to an end of the axial tube 33 via the adapter 34. The lock core unit 32 is an elongated member having cross section somewhat like figure eight. Preferably, the lock core unit 32 consists of a lock core 321, a limiting flange 322, an actuating plate 323 and an elastic member 324. In operation, a correct key (not labeled) can be inserted into the lock core 321 for rotating either of the limiting flange 322 or the actuating plate 323. The limiting flange 322 is extended from and retracted into the lock core unit 32 so that it can assemble with or disassemble from the lever 31 for replacing a new lock core unit. The actuating plate 323 has an end connected to an end of the lock core 321 and the elastic member 324 is located between the lock core 321 and the actuating plate 323 for adjusting a distance therebetween. Consequently, it can be appreciated that a single length of the actuating plate 323 is available for various lengths of lock core specifications.

In unlocking operation, the correct key is able to rotate the actuating plate 323 which can synchronously drive a latch bolt unit (not shown) for unlocking. Preferably, the actuating plate 323 is a one-piece flat member made of a relatively rigid metal sheet by stamping or punching process. Alternatively, an end of the actuating plate 323 can be designed and twisted to form a single twist member with a predetermined angle that is suitable for various assembling directions of latch bolt units.

Further, construction of the axial tube 33 shall be described in detail, referring again to FIGS. 3 and 4. The axial tube 33 is a barrel and provides with a longitudinal slot 331 and a transverse-retaining recession 332 formed therein. In addition, the axial tube 33 further provides with a combination slot 333. By use the longitudinal slot 331 and the transverse-retaining recession 332, the axial tube 33 is combined with the lever 31 and the adapter 34. Preferably, the transverse-retaining recession 332 is located proximate a bottom corner of the longitudinal slot 331. The combination slot 333 is used for accommodating the lock core unit 32 while the lock core unit 32 combining with the axial tube 33.

Further, construction of the adapter 34 shall be described in detail, referring again to FIGS. 3 and 4. The adapter 34 is a relatively thin barrel which is normally fitted into the axial tube 33. The adapter 34 includes a positioning member 341, a combination slot 342 and a limiting groove 343. The combination slot 342 is used for accommodating the lock core unit 32 while the lock core unit 32 combining with the adapter 34. Preferably, dimensions of the combination slot 342 are as large as that of the combination slot 333 of the axial tube 33. The limiting groove 343 is located at either side of the combination slot 342 and used to engage with the limiting flange 322 of the lock core unit 32 so as to prevent removal of the lock core unit 32 from the adapter 34. In operation, once the correct key rotates the lock core 321 to retract the limiting flange 322, the removal of the lock core unit 32 from the adapter 34 is allowed. To intensify, or strengthen, the entire structure, the combination slot 342 bears a bottom portion regarded as a reinforcing connecting ring 344 that is sufficiently rigid and strong to withstand normal use.

Figure 5:
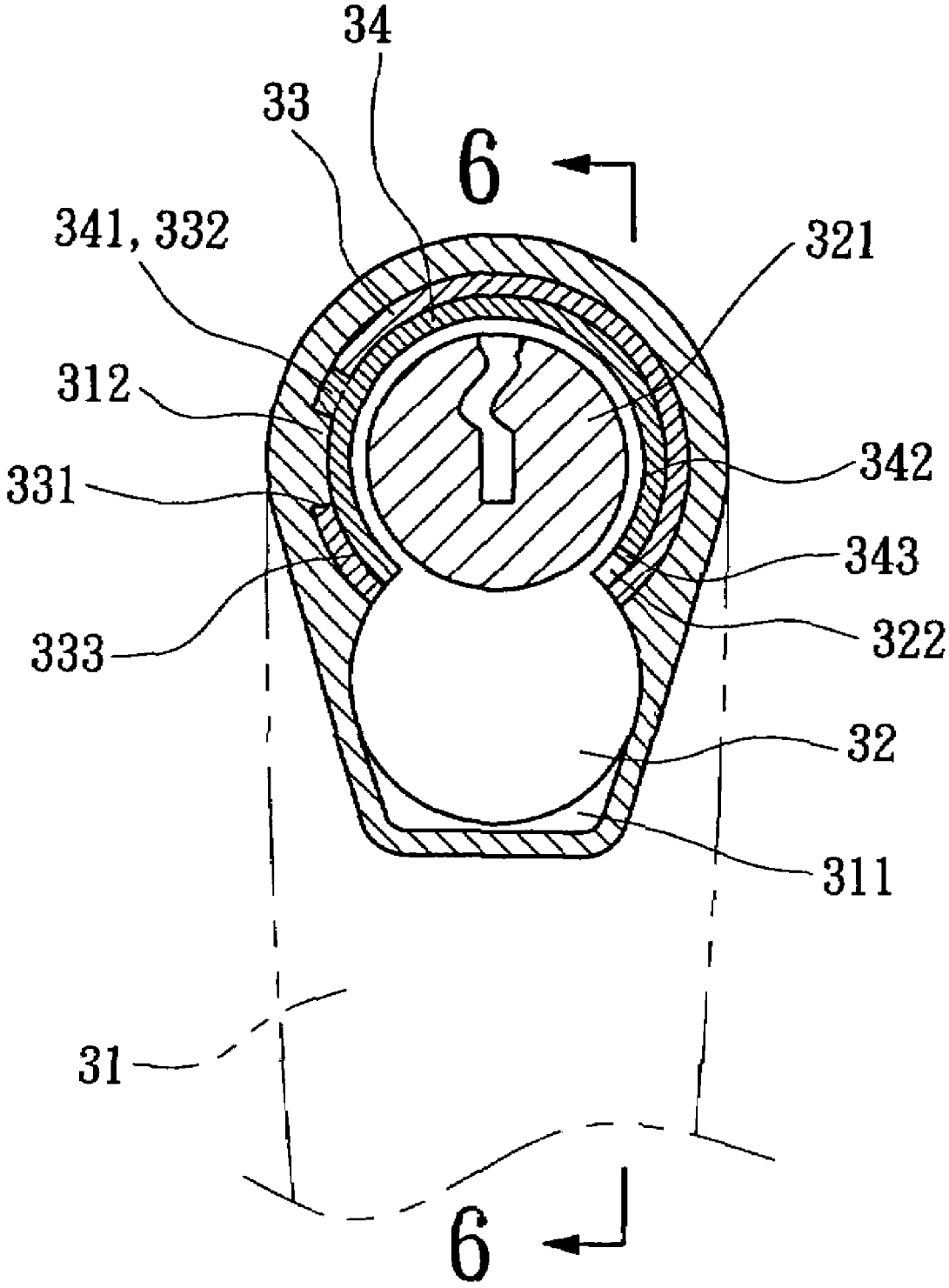
FIG. 5 is a partial cross-sectional view, taken along line 5—5 in FIG. 4, of the assembling structure for the door lock in accordance with the first embodiment of the present invention.
Figure 6:
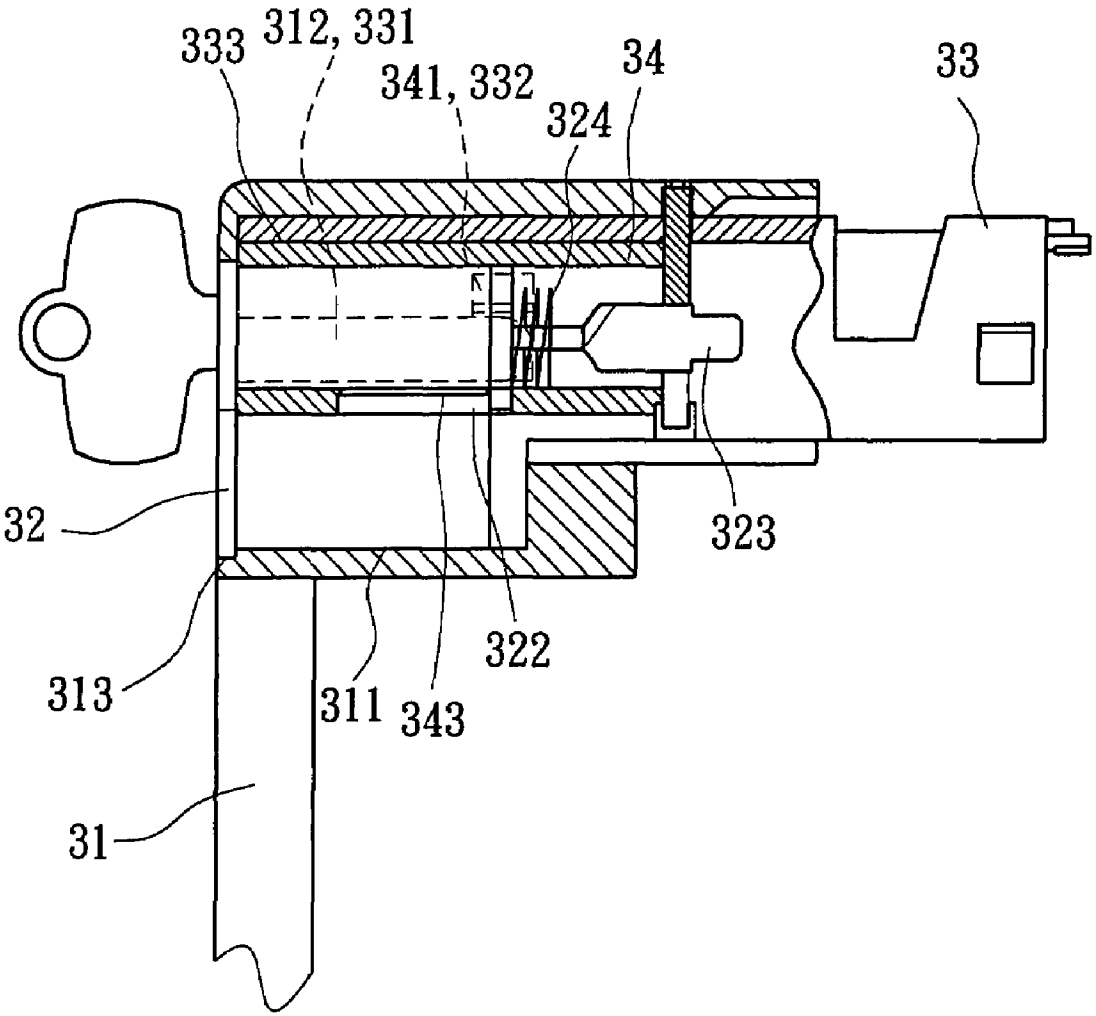
FIG. 6 is a partially cross-sectional view, taken along line 6—6 in FIG. 5, of the assembling structure for the door lock in accordance with the first embodiment of the present invention.

Turning now to FIGS. 4 through 6, firstly, when the adapter 34 and the axial tube 33 are assembled, the positioning member 341 of the adapter 34 is engaged with the transverse-retaining recession 332 of the axial tube 33 via the longitudinal slot 331. Subsequently, the axial tube 33 and the adapter 34 constitute a combination unit. At that time, no axial movement of the adapter 34 with respect to the axial tube 33 is allowed since the positioning member 341 of the adapter 34 is confined within the traverse-retaining recession 331 of the axial tube 33. Once the axial tube 33 is completely sleeved on the adapter 34, the combination slot 333 of the axial tube 33 is aligned with the combination slot 342 of the adapter 34 so as to receive the lock core unit 32 therein.

Referring again to FIGS. 4 through 6, secondly, assembling the lever 31 and the combination unit of the axial tube 33 and the adapter 34, the engaging member 312 of the lever 31 is engaged with the longitudinal slot 331 of the axial tube 33. Subsequently, compartment 311 of the lever 31 accommodates the combination unit of the axial tube 33 and the adapter 34, and thus the adapter 34 is located between the lever 31 and the axial tube 33. Due to obstruction of the engaging member 312 of the lever 31 in the longitudinal slot 331 of the axial tube 33, the positioning member 341 of the adapter 34 is confined and unable to return to the longitudinal slot 331 of the axial tube 33. Consequently, no rotational movement of the adapter 34 with respect to the axial tube 33 is allowed.

Referring again to FIGS. 4 through 6, finally, assembling the lever 31 and the lock core unit 32, the lock core unit 32 is inserted into the assembling hole 313 of the lever 31. Meanwhile, the lock core unit 32 can avoid any obstruction of the adapter 34 in the assembling hole 313 since no rotational movement of the adapter 34 with respect to the axial tube 33 is allowed. Consequently, either of assembling or disassembling operation of the lock core unit 32 can be speeded up.

Figure 7:
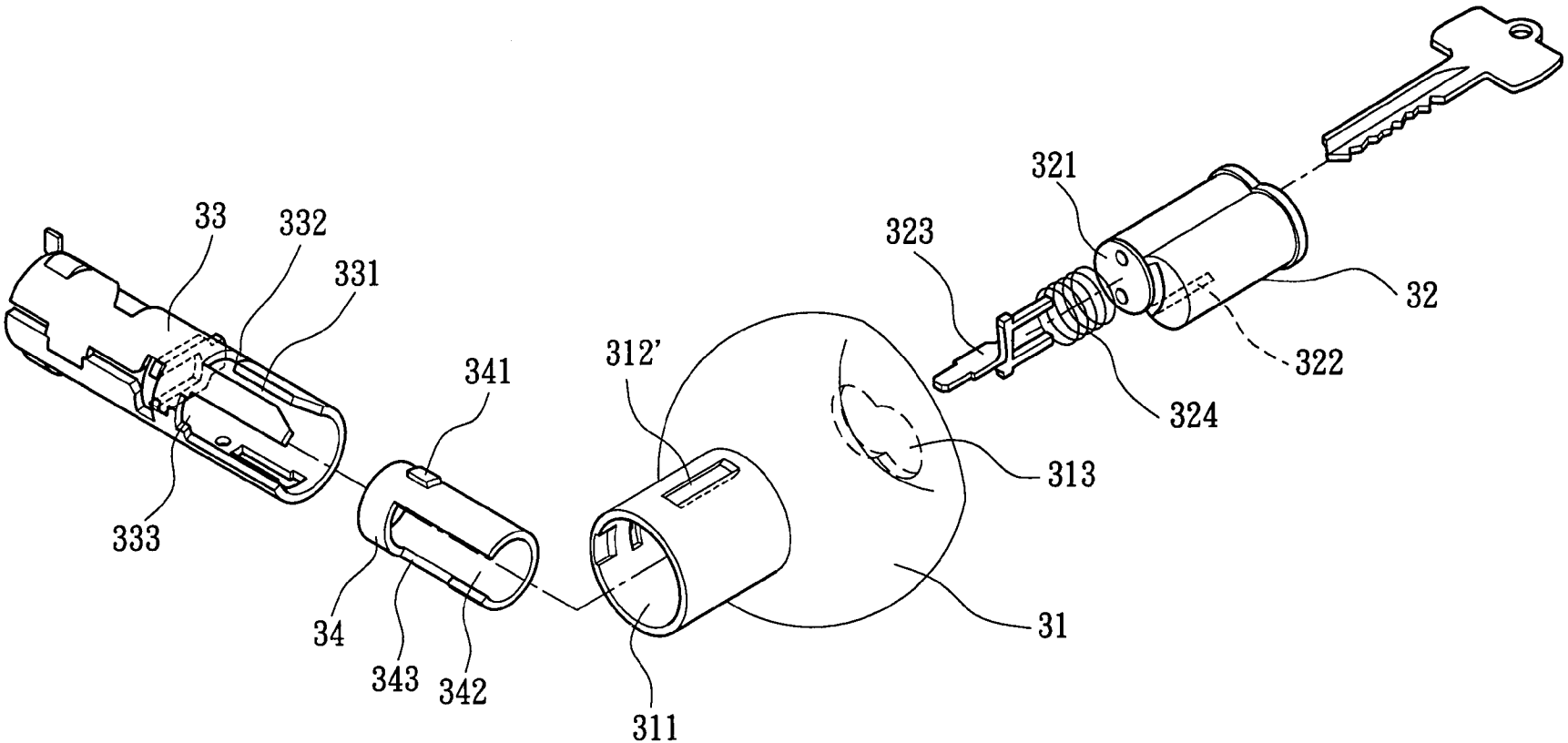
FIG. 7 is an exploded perspective view of an assembling structure for a door lock in accordance with a second embodiment of the present invention.

Turning now to FIG. 7, reference numerals of the second embodiment has applied the identical numerals of the assembling structure of the first embodiment. The assembling structure of the second embodiment has the similar configuration and same function as that of the first embodiment and the detailed descriptions are omitted.

Referring to FIG. 7, an assembling structure for a door lock in accordance with a second embodiment of the present invention essentially includes a lever 31, a lock core unit 32, an axial tube 33 and an adapter 34 assembled together. In comparison with the first embodiment, the lever 31 of the second embodiment is a doorknob and consists of a compartment 311, an engaging member 312' and an assembling hole 313 used to assemble the lock core unit 32, the axial tube 33 and the adapter 34. Particularly, the engaging member 312' is stamped on a neck portion of the lever 31 that constitutes one-piece member of the engaging member 312' and the lever 31.

Figure 8:
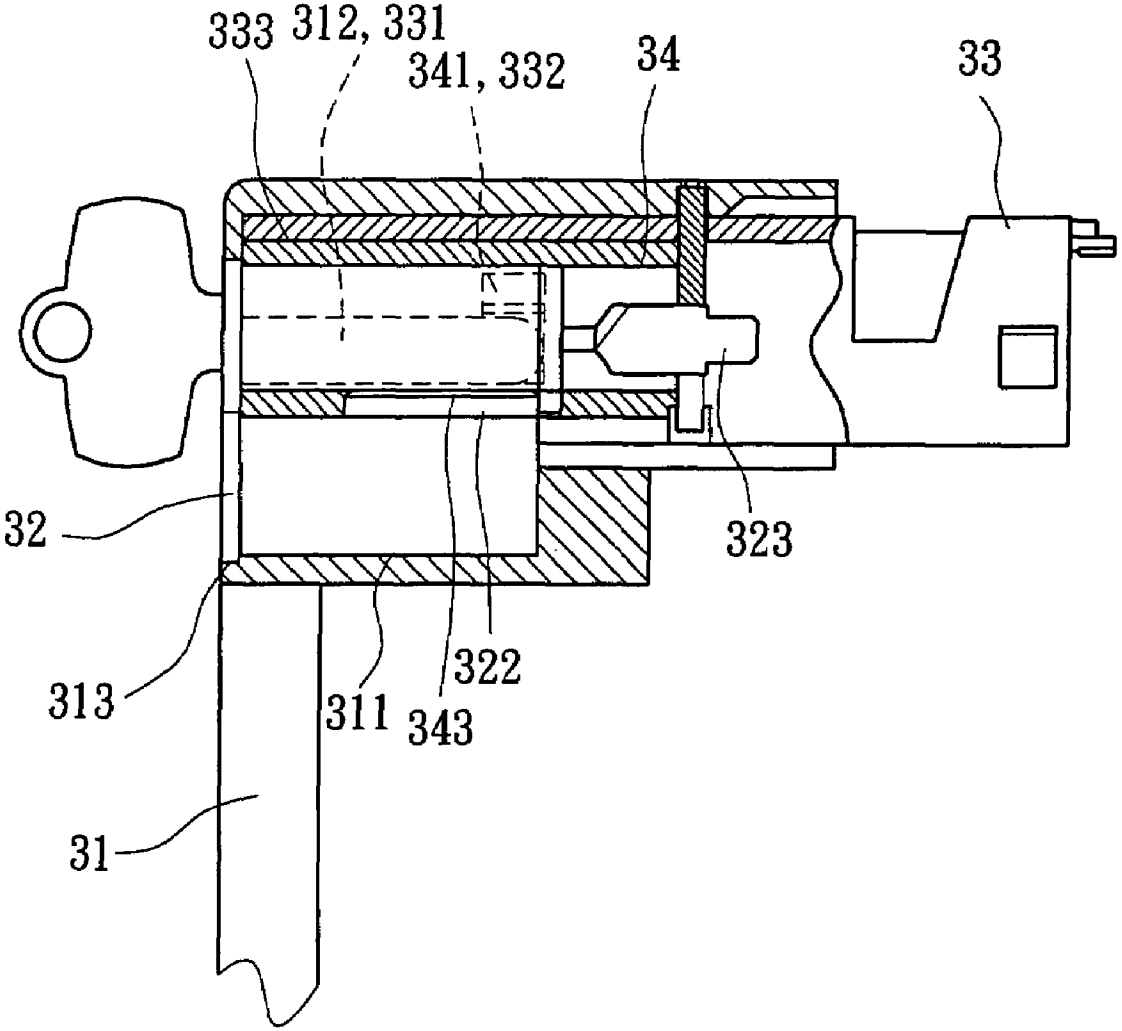
FIG. 8 is a partial cross-sectional view of the assembling structure for the door lock in accordance with the first embodiment of the present invention applied to another length of a lock core unit.

Turning now to FIG. 8, the assembling structure of the first embodiment is applied to another lock core unit 32 having a relatively longer length. Generally, various lengths of the lock core unit 32 may be designed according to numbers of cotter pin holes arranged along an axis. Referring back to FIGS. 1 through 6, a relatively shorter length of the lock core unit 32 is provided. It will be also appreciated that the elastic member 324 is employed adjusting a distance between an end of the lock core 321 and the actuating plate 323. Thus, it ensures the end of the actuating plate 323 connecting with and driving the latch bolt unit (not shown). In design choice, the actuating plate 323 with a relatively longer length, disclosed in FIG. 8, can omit the elastic member 324 and still avoid disassembling of the actuating plate 323 from the lock core 321.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. An assembling structure for a door lock, comprising:

a lever having a compartment, an engaging member and an assembling hole, the engaging member being formed in the compartment and the assembling hole being connected with the compartment;

a lock core unit inserted into the lever, with a passage through the assembling hole;

an axial tube inserted into the compartment of the lever, the axial tube including a longitudinal slot and a transverse-retaining recess formed therein; such that the longitudinal slot is connected with the transverse-retaining recess; and an adapter combined with an end of the axial tube to thereby assemble the lock core unit, the adapter including a positioning member;

wherein assembling the axial tube and the adapter, the positioning member of the adapter is engaged in and confined within the transverse-retaining recess of the axial tube via the longitudinal slot, thereby constituting a combination unit of the axial tube and the adapter and preventing disengagement of the combination unit of the axial tube and the adapter in the following assembling operation;

and wherein assembling the lever and the combination unit of the axial tube and the adapter, the engaging member of the lever is engaged with the longitudinal slot of the axial tube and further engaged with the positioning member of the adapter so as to prevent releasing the positioning member of the adapter from the transverse-retaining recess of the axial tube, and, due to obstruction of the engaging member of the lever in the longitudinal slot of the axial tube, the positioning member of the adapter cannot return to the longitudinal slot of the axial tube such that no rotational movement of the adapter with respect to the axial tube is allowed.

2. The assembling structure for the door lock as defined in claim 1, wherein the lever is a door lever.

3. The assembling structure for the door lock as defined in claim 1, wherein the lever is a doorknob.

4. The assembling structure for the door lock as defined in claim 1, wherein the lock core unit includes a lock core, an actuating plate and an elastic member, and the elastic member is located between the lock core and the actuating member for adjusting an appropriate distance while an end of the actuating plate is connected with an end of the lock core.

5. The assembling structure for the door lock as defined in claim 1, wherein the axial tube further includes a first combination slot and the adapter further includes a second combination slot;

wherein once the axial tube and the adapter are assembled, the first combination slot is aligned with the second combination slot.

6. The assembling structure for the door lock as defined in claim 5, wherein the second combination slot of the adapter further includes a limiting groove and the lock core unit further includes a limiting flange;

wherein the limiting flange is used to engage with the limiting groove so as to confine the lock core unit within the adapter.

7. The assembling structure for the door lock as defined in claim 5, wherein the second combination slot of the adapter further includes a bottom portion regarded as a reinforcing connection ring that strengthens the entire structure of the adapter.

8. The assembling structure for the door lock as defined in claim 4, wherein an end of the actuating plate can be designed and twisted to form a single twist member with a predetermined angle that is suitable for various assembling directions of latch bolt units.

* * * * *